US011419442B1

(12) United States Patent
Nguegang

(10) Patent No.: US 11,419,442 B1
(45) Date of Patent: Aug. 23, 2022

(54) TRAY ASSEMBLY

(71) Applicant: Bear Robotics, Inc., Redwood City, CA (US)

(72) Inventor: Gino Nguegang, San Mateo, CA (US)

(73) Assignee: Bear Robotics, Inc., Redwood City, CA (US)

( * ) Notice: Subject to any disclaimer, the term of this patent is extended or adjusted under 35 U.S.C. 154(b) by 40 days.

(21) Appl. No.: 17/206,516

(22) Filed: Mar. 19, 2021

(51) Int. Cl.
*B65D 21/02* (2006.01)
*A47G 23/08* (2006.01)

(52) U.S. Cl.
CPC ..... *A47G 23/08* (2013.01)

(58) Field of Classification Search
CPC ..... B65D 1/34; B65D 1/36; B65D 81/3453; B65D 77/0433; B65D 21/0208; B65D 21/0233; B65D 21/0204; B65D 21/0201; B65D 21/0202
USPC ..... 220/23.83, 557, 561, 564
See application file for complete search history.

(56) References Cited

U.S. PATENT DOCUMENTS 5,842,486 A * 12/1998 Davis ..... A45C 13/008 132/301
2002/0179614 A1* 12/2002 Rohlfs ..... B65D 81/3876 220/713
2015/0176318 A1* 6/2015 Gundersen ..... E05D 7/12 16/252
2017/0232318 A1* 8/2017 Topolosky ..... B65D 21/0233 220/737
2019/0009968 A1* 1/2019 Chiang ..... B65D 81/261

* cited by examiner

*Primary Examiner* — King M Chu
(74) *Attorney, Agent, or Firm* — Dinsmore & Shohl LLP; Yongsok Choi, Esq.

(57) ABSTRACT

A tray includes a first tray configured to be fixedly mounted to a robot; a second tray provided above the first tray and configured to be rotatably coupled to the first tray; and at least one pad assembly positioned between the first tray and the second tray. Each of the at least one pad assembly includes at least one rolling member provided in a direction toward the first tray and an elastic member having at least one end fixedly connected to an interior of the at least one pad assembly. The at least one pad assembly is coupled to the second tray and is mounted to be rotatable relative to the first tray. When the second tray is rotated relative to the first tray, the second tray is configured to be returned to its original position by virtue of a restoring force of an elastic member of the pad assembly.

13 Claims, 8 Drawing Sheets

PRIOR ART

TRAY ASSEMBLY

FIELD OF THE INVENTION

The present disclosure relates to a tray assembly, more particularly, to a tray assembly which can be used in a robot for serving foods and/or beverages while being mounted to the robot.

BACKGROUND

As a robot technology advances, there are increasing interest in and demand for not only industrial robots but also service robots. The service robots have been applied in various fields of daily life. Among such service robots, an autonomous driving serving robot that carries foods ordered by a customer to a table of the customer in a restaurant or the like is known. The serving robot has the advantage of maximizing the operational efficiency of the restaurant and improving the quality of customer services, and thus is getting a lot of attention in recent years.

FIG. 1 exemplarily shows illustrating a robot for serving of foods and/or beverages. Referring to FIG. 1, a robot 10 includes a drive part 11 for movement of the robot 10 and a main body 12 mounted on an upper end of the drive part 11. The main body 12 may be equipped with a device which enables a user to input commands or a device capable of receiving the user's commands through a wireless communication. Based on the commands inputted by the user, the robot autonomously travels to serve foods and/or beverages or move dishes after a meal. In addition, a tray may be placed on the upper surface of the main body 12 to serve the foods and/or beverages, or move the dishes.

During movement of the robot 10 or when the user picking up dishes and/or cups, impact may be applied to the tray placed on the upper surface of the main body 12 and vibration may be transmitted to the tray.

This situation may cause a problem that, if the tray is not stably mounted to the main body 12, the tray may be separated from the robot 10 and thus the foods and/or the beverages, or the dishes on the tray may drop down. In addition, even if the tray is stably mounted to the main body 12, the impact or vibration applied to the tray may be directly transmitted to the foods and/or the beverages, or the dishes, which may cause a problem that the foods and/or the beverages are spilled due to the vibration or the like.

Accordingly, with the development of the serving robot, a demand has existed for the development of a dedicated tray that can be stably mounted to the serving robot and can serve foods and/or beverages without any problems.

SUMMARY OF THE INVENTION

One object of the present disclosure is to provide a tray assembly which can be used in a robot for serving foods and/or beverages while being stably mounted to the robot.

Another object of the present disclosure is to provide a tray assembly which is capable of supporting serving for foods and/or beverages in a more stable manner by absorbing for impact or vibration that may be transmitted to a tray with movement of a robot.

Yet another object of the present disclosure is to provide a tray assembly which can be easily separated from a robot for maintenance.

According to one embodiment of the present disclosure, there is provided a tray assembly, comprising: a first tray configured to be fixedly mounted to a robot; a second tray provided above the first tray and configured to be rotatably coupled to the first tray; and at least one pad assembly disposed between the first tray and the second tray. Each of the at least one pad assembly comprises at least one rolling member provided in a direction toward the first tray and an elastic member having at least one end fixedly connected to an interior of the at least one pad assembly. The at least one pad assembly is coupled to the second tray and is mounted to be rotatable relative to the first tray. When the second tray is rotated relative to the first tray, the second tray is configured to be returned to its original position by virtue of a restoring force of an elastic member of the pad assembly.

According to one embodiment of the present disclosure, the second tray may comprise at least one connection member provided on a lower surface of the second tray, which faces the first tray, and at least one connection hole may be formed at a position corresponding to the at least one connection member in the first tray, and the at least one connection member may be configured to be inserted into the at least one connection hole when the first tray and the second tray are coupled to each other.

According to one embodiment of the present disclosure, the first tray may comprise at least one elastic member mounting portion formed on an upper surface of the first tray, which faces the at least one pad assembly, to protrude toward the at least one pad assembly, and the elastic member of the at least one pad assembly may be mounted to an elastic member mounting portion of the first tray. When the second tray is rotated relative to the first tray, the at least one pad assembly may be configured to be rotated together with the rotation of the second tray so that the restoring force is generated by the elastic member.

According to one embodiment of the present disclosure, the elastic member of the at least one pad assembly may comprise a plurality of tension springs, and the plurality of tension springs may be mounted to the at least one elastic member mounting portion of the first tray to enclose the at least one elastic member mounting portion.

According to one embodiment of the present disclosure, the second tray may comprise at least one connection member provided at a position corresponding to the at least one elastic member mounting portion of the first tray on a lower surface of the second tray, which faces the first tray. At least one connection hole may be formed in the at least one elastic member mounting portion of the first tray. When the first tray and the second tray are coupled to each other, the at least one connection member of the second tray may be configured to penetrate through the at least one pad assembly and be inserted into the at least one connection hole of the first tray.

According to one embodiment of the present disclosure, the at least one pad assembly may further comprise an elastic member fixing pin provided on an inner side surface of the at least one pad assembly, and at least one end of the elastic member may be fixedly connected to the elastic member fixing pin.

According to one embodiment of the present disclosure, at least one slot may be formed on a side surface of the first tray, the second tray may comprise a coupling member provided at a position corresponding to the at least one slot on a side surface of the second tray. The at least one slot of the first tray may be formed to be elongated along a circumferential direction of the first tray such that the coupling member of the second tray is inserted into the at least one slot of the first tray and is configured to be rotatable along the circumferential direction of the first tray.

According to one embodiment of the present disclosure, the at least one rolling member may comprise a plurality of rolling members provided in each of the at least one pad assembly along a circumferential direction.

According to one embodiment of the present disclosure, the at least one rolling member may be configured to be rollable in contact with an upper surface of the first tray facing the at least one pad assembly.

According to one embodiment of the present disclosure, the at least one pad assembly may further comprise at least one damping member.

According to one embodiment of the present disclosure, the at least one damping member may comprise a plurality of damping members provided in each of the at least one pad assembly along a circumferential direction.

According to one embodiment of the present disclosure, the at least one pad assembly may comprise two or more pad assemblies, and the two or more pad assemblies may be arranged on the first tray in a rotational symmetry relationship around a center of the first tray.

According to one embodiment of the present disclosure, the at least one pad assembly may comprise three pad assemblies.

According to one embodiment of the present disclosure, by fixedly mounting a tray assembly to a robot, it is possible to implement a stable serving for foods and/or beverages.

Further, by allowing trays constituting a tray assembly to be rotatably coupled to each other and by adsorbing impact or vibration which may be transmitted to the trays, it is possible to more stably implement serving for foods and/or beverages without spilling.

Further, by configuring trays constituting a tray assembly to be easily separated from each other, it is possible to facilitate maintenance.

DETAILED DESCRIPTION

Figure 1:
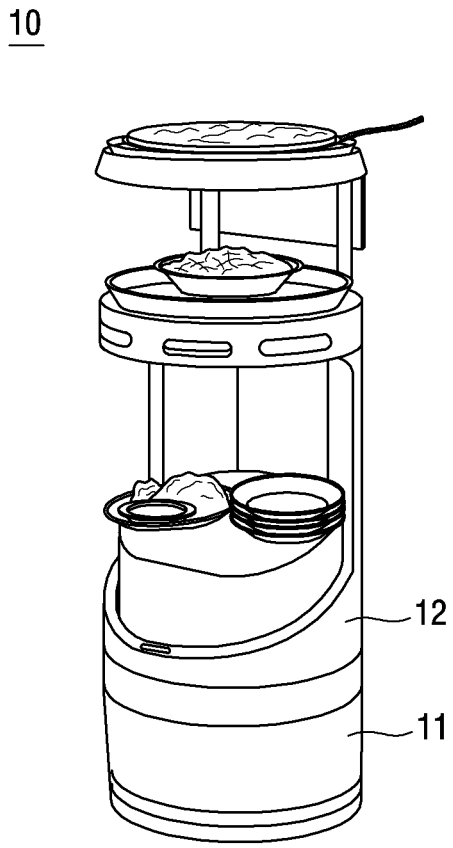
FIG. 1 exemplarily shows illustrating a robot for serving foods and/or beverages.

Hereinafter, preferred embodiments of the present disclosure will be described in detail with reference to the appended drawings to such an extent that the present disclosure can be readily practiced by one of ordinary skill in the art.

Detailed descriptions of parts irrelevant to the present disclosure will be omitted for the purpose of more clearly describing the present disclosure. Throughout the specification, the same components will be described using like reference numerals. In addition, the sizes, thicknesses, positions, and the like of the respective components shown in the drawings are arbitrarily shown for the sake of convenience in description, and hence the present disclosure is not necessarily limited thereto. That is, it should be understood that specific shapes, configurations, and characteristics described in the specification may be modified in various embodiments without departing from the spirit and scope of the prevent disclosure, and positions or arrangements of individual components may be modified without departing from the spirit and scope of the prevent disclosure.

Therefore, detailed descriptions to be described below should be construed as non-limitative senses, and the scope of the prevent disclosure should be understood to include appended claims and their equivalents.

Figure 2:
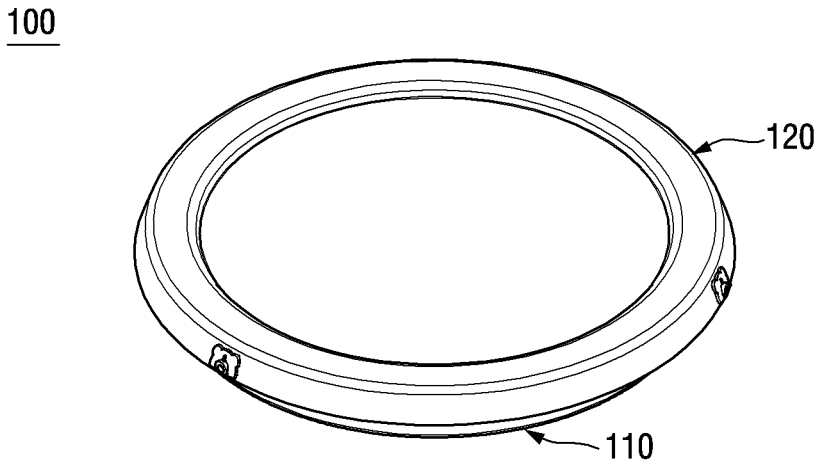
FIG. 2 shows a tray assembly according to one embodiment of the present disclosure.
Figure 3:
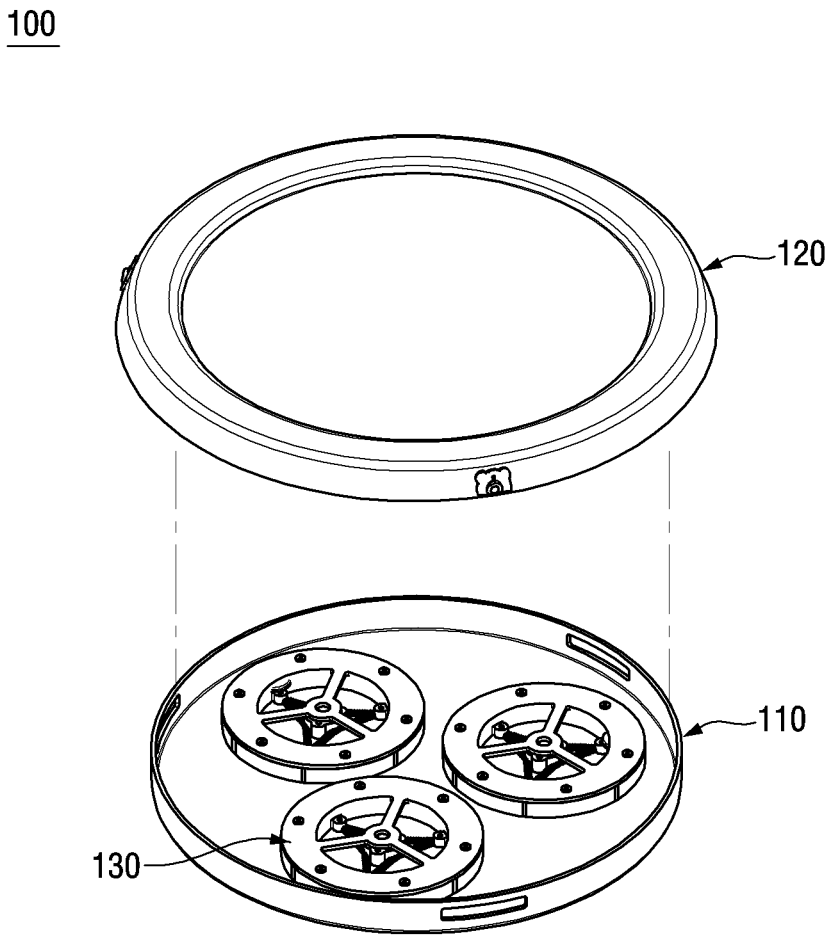
FIG. 3 is an exploded view of a first tray and a second tray in the tray assembly according to one embodiment of the present disclosure, when obliquely viewed from above.

FIG. 2 shows a tray assembly according to one embodiment of the present disclosure. FIG. 3 is an exploded view of a first tray and a second tray in the tray assembly according to one embodiment of the present disclosure, when obliquely viewed from above.

Referring to FIGS. 2 and 3, a tray assembly 100 according to one embodiment of the present disclosure includes a first tray 110, a second tray 120, and a pad assembly 130.

The first tray 110 of the tray assembly 100 according to one embodiment of the present disclosure is mounted to a robot to perform a function of fixing the tray assembly 100 to the robot. Further, the first tray 110 may be configured to have a lower surface that faces the robot and is to be fixedly mounted to the robot. The configuration in which the first tray 110 is mounted to the robot may employ various known coupling methods such as a mechanical coupling, a magnetic force-based coupling, and the like, and thus a description thereof will be omitted herein. Further, the first tray 110 may be detachably mounted to the robot for maintenance.

The second tray 120 of the tray assembly 100 according to one embodiment of the present disclosure performs a function of placing and holding dishes, cups, and the like thereon for serving of foods and/or beverages. To do this, the second tray 120 may be coupled to the first tray 110 from above. In particular, the second tray 120 may be rotatably coupled to the first tray 110.

The pad assembly 130 of the tray assembly 100 according to one embodiment of the present disclosure is located between the first tray 110 and the second tray 120, and performs a function of returning the second tray 120 to its original position when the second tray 120 is rotated relative to the first tray 110, and attenuating vibration or the like which may be generated during the returning. According to this embodiment, three pad assemblies 130 may be provided in three locations in a rotational symmetry relationship around the center of the first tray 110 on the upper surface of the first tray 110. However, the number of pad assemblies 130 may vary depending on the size or rotational range of the tray assembly 100, the load of foods and/or beverages to be carried by the tray assembly 100, or the like.

Hereinafter, a configuration of the tray assembly 100 according to one embodiment of the present disclosure is described in detail with reference to the drawings.

Figure 4:
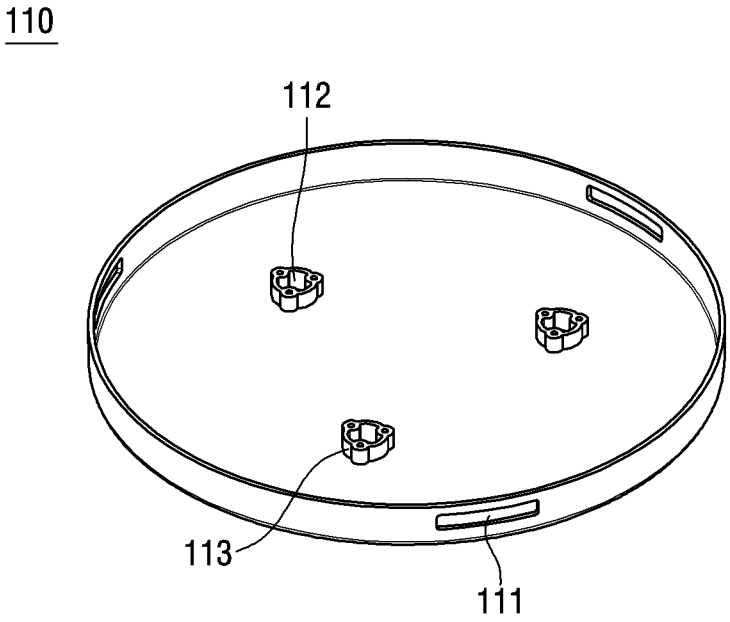
FIG. 4 shows the first tray of the tray assembly according to one embodiment of the present disclosure.
Figure 5:
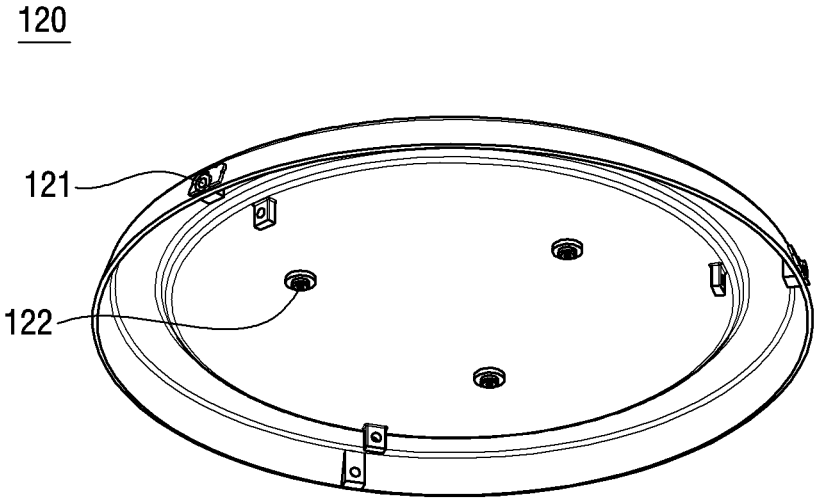
FIG. 5 shows the second tray of the tray assembly according to one embodiment of the present disclosure.
Figure 6:
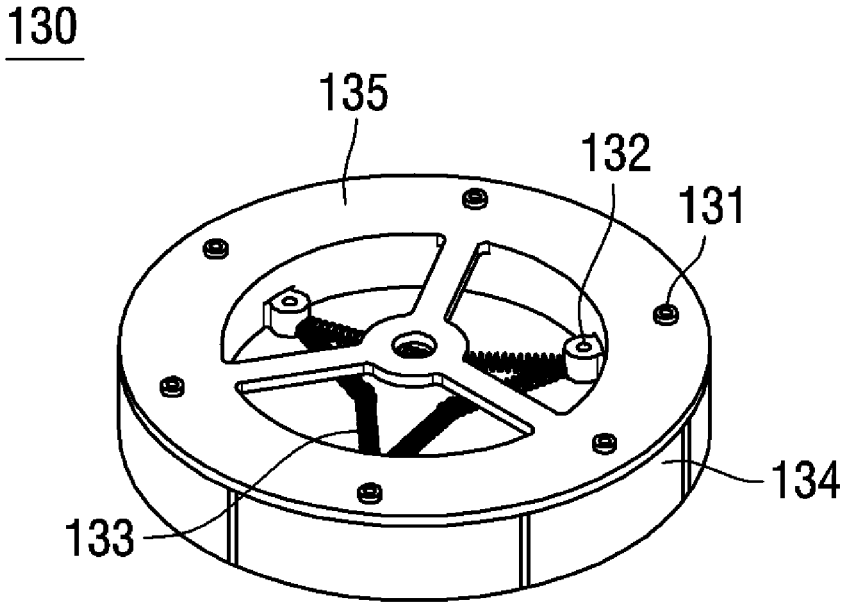
FIG. 6 is a view of a pad assembly of the tray assembly according to one embodiment of the present disclosure, when obliquely viewed from above.
Figure 7:
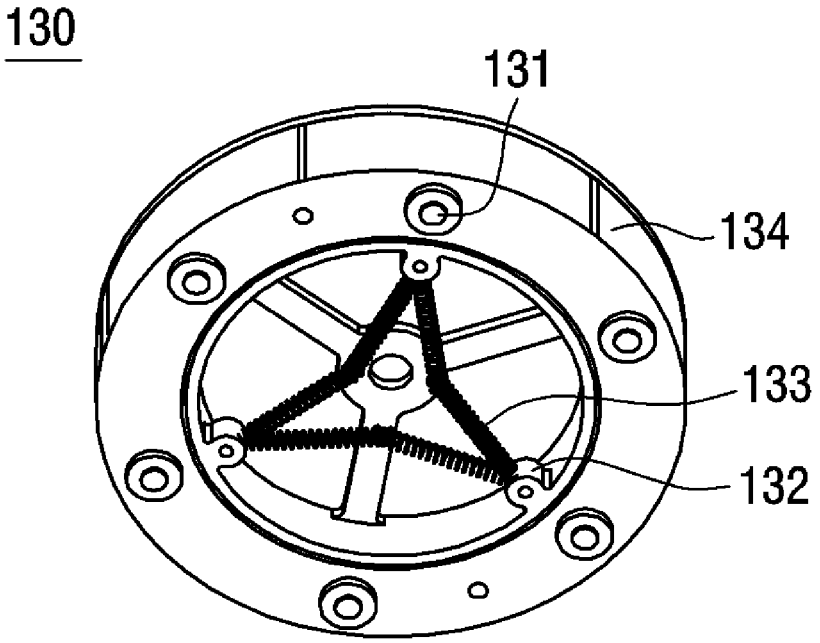
FIG. 7 is a view of the pad assembly of the tray assembly according to one embodiment of the present disclosure, when obliquely viewed from below.

FIG. 4 shows the first tray of the tray assembly according to one embodiment of the present disclosure. FIG. 5 shows the second tray of the tray assembly according to one embodiment of the present disclosure. FIGS. 6 and 7 are exploded views of the pad assembly of the tray assembly according to one embodiment of the present disclosure, when obliquely viewed from above and below, respectively.

First, referring to FIGS. 4 and 5, at least one slot 111 may be formed on a side surface of the first tray 110 according to one embodiment of the present disclosure. A coupling member 121 may be provided at a position corresponding to the at least one slot 111 of the first tray 110 on a side surface of the second tray 120. Accordingly, the coupling member 121 of the second tray 120 is inserted into the at least one slot 111 of the first tray 110 such that the first tray 110 and the second tray 120 can be coupled to each other.

The at least one slot 111 formed in the side surface of the first tray 110 may be formed to be elongated along a circumferential direction of the first tray 110. The coupling member 121 of the second tray 120 may be screws that can be inserted into the slot 111. Thus, the coupling member 121 is movable along the circumferential direction of the first tray 110 in a state in which the coupling member 121 is inserted into the slot 111. With this configuration, the second tray 120 can rotate relative to the first tray 110. Further, this configuration makes it possible to secure a stable coupling between the first tray 110 and the second tray 120 by preventing the second tray 120 from being separated from the first tray 110 when the tray assembly 100 is lifted up.

In the present embodiment, three slots 111 may be formed along the circumferential direction of the first tray 110, and three coupling members 121 may be provided on the second tray 120 to correspond to the three slots 111. The number of slots 111 and the number of coupling members 121 are not limited thereto but may be set to various numbers such as one, two, or four or more.

The first tray 110 according to one embodiment of the present disclosure may include an elastic member mounting portion 113 formed on the upper surface of the first tray 110, which faces the second tray 120 and the pad assembly 130, to protrude toward the second tray 120 and the pad assembly 130. The elastic member mounting portion 113 of the first tray 110 are provided to mount an elastic member 133 of the pad assembly 130 (to be described later) thereon. The number and position of the elastic member mounting portion 113 corresponds to the number and position of the pad assembly 130. In this embodiment, as illustrated in the figures, three elastic member mounting portions 113 may be formed on the upper surface of the first tray 110 in a rotational symmetry relationship around the center of the first tray 110.

The second tray 120 according to one embodiment of the present disclosure may include a connection member 122 provided on a lower surface of the second tray 120, which faces the first tray 110 and the pad assembly 130, to protrude toward the first tray 110 and the pad assembly 130. Further, a connection hole 112 may be formed at a position corresponding to the connection member 122 of the second tray 120 in the first tray 110. The connection member 122 may be inserted into the connection hole 112 when the first tray 110 and the second tray 120 are coupled to each other.

According to this embodiment, the connection hole 112 of the first tray 110 may be formed in the center of the elastic member mounting portion 113, and the connection member 122 of the second tray 120 may penetrate through the pad assembly 130 and be inserted into the connection hole 112 of the first tray 110. With such a configuration, the first tray 110 and the second tray 120 can be coupled to each other with the pad assembly 130 interposed therebetween, and the pad assembly 130 can also be stably located between the first tray 110 and the second tray 120.

Referring to FIGS. 6 and 7, the pad assembly 130 of the tray assembly 100 according to one embodiment of the present disclosure may include a rolling member 131, an elastic member fixing pin 132, an elastic member 133, a damping member 134 and a housing 135.

The pad assembly 130 according to this embodiment is configured such that the rolling member 131, the elastic member fixing pin 132, the elastic member 133, and the damping member 134 are mounted to the housing 135 having a substantially ring shape. A lower portion of the housing 135, which faces the first tray 110, is opened. A support member may be provided at an upper portion of the housing 135, which faces the second tray 120, to close the upper portion of the housing 135.

As described above, when the first tray 110 and the second tray 120 are coupled to each other, the connection member 122 of the second tray 120 may penetrate through the pad assembly 130 and be inserted into the connection hole 112 of the first tray 110. To this end, a hole is formed in the center of the support member provided at the upper portion of the housing 135 of the pad assembly 130. The connection member 122 of the second tray 120 may pass through the hole of the support member of the upper portion of the housing 135 and be inserted into the connection hole 112 of the first tray 110. The hole formed in the support member of the upper portion of the housing 135 of the pad assembly 130 has a diameter corresponding to that of the connection member 122 of the second tray 120 so that the second tray 120 and the pad assembly 130 can be tightly coupled to each other. With this configuration, it is possible to stably locate the pad assembly 130 between the first tray 110 and the second tray 120, and rotate the pad assembly 130 together with the second tray 120 when the second tray 120 is coupled to the first tray 110 and then rotated.

The rolling member 131 of the pad assembly 130 according to one embodiment of the present disclosure performs a function of allowing the pad assembly 130 to rotate together with the second tray 120 when the second tray 120 is rotated relative to the first tray 110, thereby facilitate the rotation of the second tray 120. The rolling member 131 may be provided along the periphery of the pad assembly 130 in a direction toward the upper surface of the first tray 110 such that the rolling member 131 is rollable in contact with the upper surface of the first tray 110 in the state in which the first tray 110 and the second tray 120 are coupled to each other.

In this embodiment, as illustrated in the figures, the rolling member 131 may include a ball housing and a ball provided to be rollable inside the ball housing, so that the ball is rollable in contact with the upper surface of the first tray 110. However, the present disclosure is not limited thereto. For example, the rolling member 131 may include the ball alone without the ball housing additionally provided, and a known rollable member such as a roller. Further, in this embodiment, the rolling member 131 of the pad assembly 130 may include six rolling members provided at regular intervals along the periphery of the housing 135 of the pad assembly 130. The number of rolling members 131 may vary depending on the size of the pad assembly 130, the rotational range of the tray assembly 100, and the like.

The elastic member 133 of the pad assembly 130 according to one embodiment of the present disclosure performs a function of applying a restoring force to the second tray 120 when the second tray 120 is rotated relative to the first tray 110 such that the second tray 120 can be returned to its original position. At least one end of the elastic member 133 of the pad assembly 130 may be fixedly connected to the pad assembly 130. Specifically, an elastic member fixing pin 132 may be provided inside the housing 135 of the pad assembly 130, and the at least one end of the elastic member 133 may be fixedly connected to the elastic member fixing pin 132.

According to one embodiment of the present disclosure, the elastic member 133 may include a plurality of springs. Specifically, the elastic member 133 may include six tension springs. One end of each of the six tension springs is mounted to the elastic member fixing pin 132, and the other end thereof is disposed toward the central portion of the pad assembly 130. In this case, the other ends of adjacent tension springs are connected to each other. In this embodiment, three elastic member fixing pins 132 may be provided, and a set of two tension springs are simultaneously mounted to one elastic member fixing pin. Accordingly, as illustrated in the figures, the six tension springs may be connected to each another with a space interposed therebetween.

The elastic member mounting portion 113 of the first tray 110 described above is positioned in the central portion of the tension springs, that is, the space formed by the six tension springs, so that the central portion in which the six tension springs are connected to each another can be mounted on the first tray 110.

Figure 8:
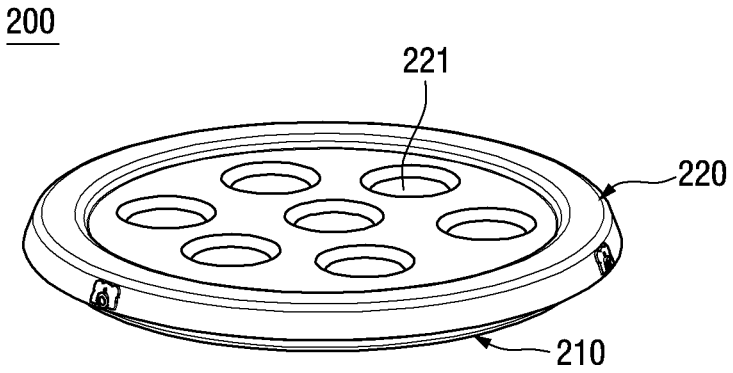
FIG. 8 is shows a tray assembly according to another embodiment of the present disclosure.

Referring to FIGS. 3 and 4 together with FIGS. 7 and 8, when the first tray 110 and the second tray 120 are coupled to each other, the center portion of the six tension springs of each pad assembly 130 may be positioned to enclose the elastic member mounting portion 113 of the first tray 110. That is, the central portion of the elastic member 133 of the pad assembly 130 may be fixed relative to the first tray 110 by the elastic member mounting portion 113. Accordingly, when the second tray 120 is rotated relative to the first tray 110, the pad assembly 130 is also rotated and the end portion side of the elastic member 133 mounted to the elastic member fixing pin 132 is caused to rotate. This generates the restoring force of the elastic member 133, thus enabling the second tray 120 to return to its original position.

While in the present embodiment, the elastic member 133 is composed of the six tension springs, the elastic member may be embodied in other forms. For example, the elastic member may be embodied with a single torsion spring. In this case, both end portions of the single torsion spring may be connected to the elastic member mounting pin, and a central coil of the single torsion spring may be attached to the elastic member mounting portion. Further, the number, arrangement, elastic modulus, and the like of the elastic members 133 may vary depending on the load of foods and/or beverages that are carried by the tray assembly 100, the expected motion of the robot, and the like.

The damping member 134 of the pad assembly 130 according to one embodiment of the present disclosure may be provided in the housing 135 of the pad assembly 130 and serve to absorb and attenuate vibration caused by the rotation of the second tray 120 and the pad assembly 130 when the second tray 120 is rotated relative to the first tray 110 and when the second tray 120 is returned to its original position, and to stop the rotation. The damping member 134 may be provided at such a position as not to hinder the rotation of the second tray 120 and the pad assembly 130, that is, a position as not to interfere with the rolling member 131 and the elastic member 133 of the pad assembly 130. For example, as illustrated in the figures, a plurality of damping members 134 may be provided along the periphery of the housing 135 of the pad assembly 130. The number and weight of damping members 125 may vary depending on the load of foods and/or beverages that are carried by the tray assembly 100, the expected operation of the robot, and the like.

As described above, the first tray 110 and the second tray 120 are rotatably coupled to each other. The second tray 120 is configured to be returned to its original position after the rotation. Thus, even if impact or vibration is transmitted to the tray assembly 100 during the movement of the robot or the operation of the user, it is possible to reduce the impact or vibration to be transmitted to the foods and/or the beverages placed on the second tray 120, and serve foods and/or beverages in a more stable manner.

Although the upper surface of the second tray 120 has been described as being flat in the above-described embodiment, the second tray 120 may have other forms.

FIG. 8 shows a tray assembly according to another embodiment of the present disclosure. Referring to FIG. 8, a tray assembly 200 according to another embodiment of the present disclosure includes a first tray 210, a second tray 220 and a pad assembly as in the above-described embodiment. The tray assembly 200 according to this embodiment differs from the above-described embodiment in that a plurality of grooves 221 are formed in an upper surface of the second tray 220.

Specifically, the plurality of grooves 221 in each of which the bottom of a cup and/or bottle is received at the time of serving, may be formed at regular intervals in the upper surface of the second tray 220 according to this embodiment. Each of the plurality of grooves 221 performs a function of stably fixing the cup and/or the bottle. The shape and size of each groove may vary in consideration of the shape and size of the cup and/or bottle to be used for serving.

As described above, in this embodiment, the plurality of grooves are formed in the upper surface of the second tray. Thus, by stably fixing the cup or bottle to the tray assembly at the time of serving, for example, the beverage, it is possible to prevent from spilling the beverage at the time of serving. In addition, it is possible to serve multiple beverages at a time, thus improving user convenience.

While the present disclosure has been described above by way of particular features such as specific components and the like, and exemplary embodiments, these embodiments are provided to further facilitate overall understanding of the present disclosure, and the present disclosure is not limited thereto. Various modifications and variations may be made from the above descriptions by those skilled in the art.

Therefore, the spirit of the present disclosure should not be limited to the above-described embodiments, and not only the append claims but also all those modified equally or equivalently to the claims are intended to fall within the scope of the spirit of the present disclosure.

What is claimed is:

1. A tray assembly, comprising:

a first tray configured to be fixedly mounted to a robot;

a second tray provided above the first tray and configured to be rotatably coupled to the first tray; and at least one pad assembly disposed between the first tray and the second tray, wherein each of the at least one pad assembly comprises at least one rolling member provided in a direction toward the first tray and an elastic member having at least one end fixedly connected to an interior of the at least one pad assembly, wherein the at least one pad assembly is coupled to the second tray and is mounted to be rotatable relative to the first tray, and wherein when the second tray is rotated relative to the first tray, the second tray is configured to be returned to its original position by virtue of a restoring force of the elastic member of the pad assembly.

2. The tray assembly of claim 1, wherein the second tray comprises at least one connection member provided on a lower surface of the second tray, which faces the first tray, wherein at least one connection hole is formed at a position corresponding to the at least one connection member in the first tray, and wherein the at least one connection member is configured to be inserted into the at least one connection hole when the first tray and the second tray are coupled to each other.

3. The tray assembly of claim 1, wherein the first tray comprises at least one elastic member mounting portion formed on an upper surface of the first tray, which faces the at least one pad assembly, to protrude toward the at least one pad assembly, wherein the elastic member of the at least one pad assembly is mounted to an elastic member mounting portion of the first tray, and wherein when the second tray is rotated relative to the first tray, the at least one pad assembly is configured to be rotated together with the rotation of the second tray so that the restoring force is generated by the elastic member.

4. The tray assembly of claim 3, wherein the elastic member of the at least one pad assembly comprises a plurality of tension springs, and the plurality of tension springs are mounted to the at least one elastic member mounting portion of the first tray to enclose the at least one elastic member mounting portion.

5. The tray assembly of claim 3, wherein the second tray comprises at least one connection member provided at a position corresponding to the at least one elastic member mounting portion of the first tray on a lower surface of the second tray, which faces the first tray, wherein at least one connection hole is formed in the at least one elastic member mounting portion of the first tray, and wherein when the first tray and the second tray are coupled to each other, the at least one connection member of the second tray is configured to penetrate through the at least one pad assembly and be inserted into the at least one connection hole of the first tray.

6. The tray assembly of claim 1, wherein the at least one pad assembly further comprises an elastic member fixing pin provided on an inner side surface of the at least one pad assembly, and wherein at least one end of the elastic member is fixedly connected to the elastic member fixing pin.

7. The tray assembly of claim 1, wherein at least one slot is formed on a side surface of the first tray, wherein the second tray comprises a coupling member provided at a position corresponding to the at least one slot on a side surface of the second tray, and wherein the at least one slot of the first tray is formed to be elongated along a circumferential direction of the first tray such that the coupling member of the second tray is inserted into the at least one slot of the first tray and is configured to be rotatable along the circumferential direction of the first tray.

8. The tray assembly of claim 1, wherein the at least one rolling member comprises a plurality of rolling members provided in each of the at least one pad assembly along a circumferential direction.

9. The tray assembly of claim 1, wherein the at least one rolling member is configured to be rollable in contact with an upper surface of the first tray facing the at least one pad assembly.

10. The tray assembly of claim 1, wherein the at least one pad assembly further comprises at least one damping member.

11. The tray assembly of claim 10, wherein the at least one damping member comprises a plurality of damping members provided in each of the at least one pad assembly along a circumferential direction.

12. The tray assembly of claim 1, wherein the at least one pad assembly comprises two or more pad assemblies, and the two or more pad assemblies are arranged on the first tray in a rotational symmetry relationship around a center of the first tray.

13. The tray assembly of claim 12, wherein the at least one pad assembly comprises three pad assemblies.

* * * * *